US006273799B1

(12) United States Patent
Pedrini

(10) Patent No.: US 6,273,799 B1
(45) Date of Patent: Aug. 14, 2001

(54) POLISHING HEAD FOR PLATE MATERIALS IN GRANITE, HARD STONE OR CERAMIC WITH ABRASIVE SEGMENTS HAVING CONTINUOUS OSCILLATING TANGENTIAL MOTION

(75) Inventor: Luigi Pedrini, Carobbio degli Angeli (IT)

(73) Assignee: Pedrini, S.p.A., Carobbio deg. angeli (IT)

( * ) Notice: Subject to any disclaimer, the term of this patent is extended or adjusted under 35 U.S.C. 154(b) by 0 days.

(21) Appl. No.: 09/423,812

(22) PCT Filed: May 11, 1998

(86) PCT No.: PCT/IT98/00115

§ 371 Date: Jan. 18, 2000

§ 102(e) Date: Jan. 18, 2000

(87) PCT Pub. No.: WO98/51445

PCT Pub. Date: Nov. 19, 1998

(30) Foreign Application Priority Data

Apr. 14, 1997 (IT) ..... MO97A0082

(51) Int. Cl.[7] ..... B24B 7/18

(52) U.S. Cl. ..... 451/159; 451/350

(58) Field of Search ..... 451/41, 350, 158–159, 451/135, 211; 125/25

(56) References Cited

U.S. PATENT DOCUMENTS 4,965,965 10/1990 Wallin et al. .
5,161,331 * 11/1992 Zambon ..... 451/41

FOREIGN PATENT DOCUMENTS

3601636 * 7/1987 (DE) ..... 451/343
437831A 7/1991 (EP) .
7127657 * 8/1982 (JP) ..... 451/41

* cited by examiner

*Primary Examiner*—Robert A. Rose

(57) ABSTRACT

A polishing head comprises a casing with abrasive segments attached thereto made to oscillate on radial shafts driven by a ring with vertical eccentric rotary motion. The ring is coupled to a first eccentric and to a crown gear is fixed to the casing while a pinion is coupled with rotational motion to a second eccentric connected to the structure of the machine. A plurality of pins are mounted on eccentric planetary gears coupled with rotational motion to the ring and to the body of the head with a further pair of crown and pinion gears provided in which the first crown gear is rigidly connected to a second pinion and rotates with it on the second eccentric. The first pinion is rigidly connected to the said first eccentric, concentrically with the axis of the head and the second crown gear is rigidly connected to the housing of the polishing head concentrically with the axis of the head.

1 Claim, 1 Drawing Sheet

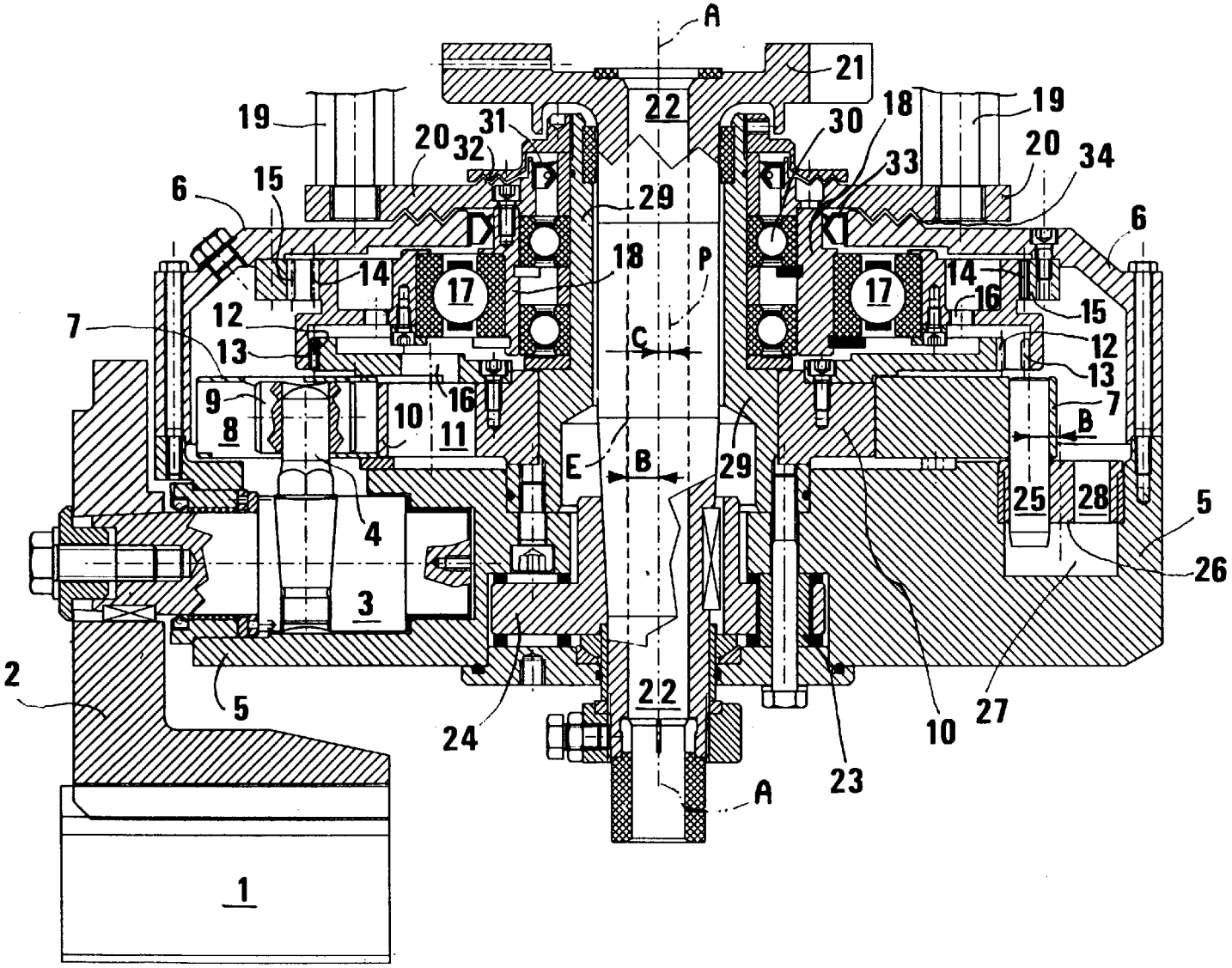
A
A
P
C
B
E
B
1
2
3
4
5
6
7
8
9
10
11
12
13
14
15
16
17
18
19
20
21
22
23
24
25
26
27
28
29
30
31
32
33
34

POLISHING HEAD FOR PLATE MATERIALS IN GRANITE, HARD STONE OR CERAMIC WITH ABRASIVE SEGMENTS HAVING CONTINUOUS OSCILLATING TANGENTIAL MOTION

The invention concerns: a polishing head for plate materials in granite, hard stone or ceramic, with abrasive segments having continuous tangential oscillating motion, that is, a rotating head which, by means of segments of abrasive material which are made to come into tangential contact with their slow oscillating motion, grinds and polishes the surface of the tile or slab of particularly hard natural or artificial material.

Prior art comprises various types of head with abrasive grinding segments with oscillating motion to grind and/or polish plate materials. The head described in patent EP 0437831 B1 is particularly relevant, in that the abrasive segments are made to oscillate on oscillating radial shafts driven by a pin each coupled, by means of a cylinder that slides in a radial direction, to a ring having vertical eccentric rotary motion with respect to the axis of the head; the said ring is made to rotate by a first eccentric, driven by a pair of gears with internal teeth, in which the crown gear is connected rigidly to the casing of the head and the pinion, also mounted on a second eccentric able to rotate freely with respect to the axis of the head, drives the said first eccentric by means of a pin attached to it, which slides in a radial groove; the eccentric rotation of the ring is controlled by a plurality of pins mounted on eccentric planetary gears with eccentricity equal to that of the said first eccentric; the second eccentric is coupled with anti-rotational joint to the structure of the machine on which the head is mounted, to provide a reaction to the motion transmitted to the said internal mechanisms.

The eccentricity of the said second eccentric is small with respect to the eccentricity of the first eccentric to lower the speed of oscillation and to achieve a slower dressing of the grinder; the eccentricity of the first eccentric is larger, sized in relation to the required dimensions, to obtain wider oscillation arcs and to avoid long segment-holder arms with consequently large vertical dimensions.

However, this solution, whilst constituting a valid improvement on previous mechanisms with cams and/or rollers, does not provide a grinding/polishing action which is reliable over a period of time, especially as regards high volumes of ceramic materials, for which all the quality control checks are employed, including the reflectivity of the polished surfaces.

These controls have shown that the said head does not provide a perfectly polished surface, but one which is polished in a discontinuous manner, with a veined finish, to the point where the materials thus machined are not acceptable.

Furthermore, the head moves the grinding segments with singular points discontinuity that occur once every 1/n of the complete forwards and backwards stroke, that is, once for every rotation of the head, where n is the number of revolutions performed by the head to achieve one complete oscillation: this causes the dressing of the grinder to be momentarily stopped, thereby causing the cutting capacity of the abrasive segments to become discontinuous, due to the sliding motion of the contact line without the required slow dressing motion.

Such prior art may be subject to considerable improvement with a view to overcoming the previously mentioned drawbacks.

From the foregoing emerges the need to resolve the technical problem of finding a new configuration of the mechanism for controlling the motion which enables the oscillating motion of the grinding segments to be continuous.

The invention resolves the said technical problem by adopting a polishing head for plate materials in granite, hard stone or ceramic with grinding segments having continuous tangential oscillating motion comprising: abrasive segments made to oscillate on radial shafts each driven by means of a pin coupled, by means of a cylinder which may slide in a radial direction, to a ring having vertical eccentric rotary motion; the said ring coupled with rotatory motion to a first eccentric driven by gears with internal teeth, with the crown gear fixed to the housing of the head and the pinion coupled with rotatory motion to the second eccentric, in turn coupled with anti-rotational joint to the structure of the machine onto which the head is mounted; a plurality of pins mounted on eccentric planetary gears, with eccentricity equal to that of the said first eccentric, and coupled with rotational motion to the said ring and to the body of the head; means for connecting the said pinion to the said first eccentric; characterised in that there are: constituting the said means for connection, another pair of crown and pinion gears, in which the first crown gear is rigidly connected to the second pinion in turn coupled with rotatory motion to the said second eccentric; the first pinion connected rigidly to the said first eccentric concentrically with respect to the axis of the head; the second crown gear rigidly connected to the housing concentrically with the axis of the head.

The advantages obtained with this invention are: with the two-stage reducing crown and pinion gears a low dressing speed of the abrasive is achieved, as the eccentricity of the said second eccentric is made to be small to obtain a low transmission ratio, made even more so by the two-stage reduction, without being limited by the high value required for the first eccentric; the dressing speed is constant throughout the oscillation stroke of the abrasive segment-holder arm, in that the motion does not have singular points of discontinuity, except at the ends of the strokes, and the abrasive grinding segments always has a new cutting edge parallel to the previous one at every point during the oscillation, thereby achieving a completely tangential cut. Also, the meshing arc between the crown gears and their respective pinions is very long and there are a large number of meshing teeth; the resulting tangential force transmitted on each tooth is therefore relatively low thereby considerably reducing wear; furthermore, the uniform distribution of the load prevents the teeth of the crown gear or pinion from being damaged should the grinding segments be subjected to shocks as a result of possible fracturing of the material during machining. Also, all the segments are in contact with the surface being machined, with the exception of the one close to the end of its stroke: with this segment the inversion of the oscillation direction may occur when not in contact with the surface being machined, as contact is guaranteed for m−1 segments, thereby avoiding the so called "pump" effect. Finally, the abrasive grinding segments are constructed without the addition of side areas of the cylindrical surface to avoid the said "pump" effect, thereby making the regeneration of the abrasive more economical and enabling it to be used completely.

An embodiment of the invention is shown, purely by way of example in the attached table in which the figure shows diametric cross-section in a vertical plane of the polishing head as described.

The figure shows: 1, the abrasive grinding segment fixed to the segment-holder arm 2 in turn splined to the oscillating radial shaft 3; 4, the pin determining the oscillating motion of the said radial shaft; 5, the body of the polishing head closed on its upper side by the housing 6; 7, the ring with radial grooves 8 in which slide the cylinders 9, each coupled to their respective pins 4 determining the oscillating motion; 10, a first eccentric driving the ring 7 in the said eccentric rotational motion: the said eccentric being coupled with rotational motion to axis A of the head with the body 5, and also coupled with eccentric rotational motion on axis E to the said ring, with eccentricity B; 11, weight saving holes in the said first eccentric; 12, a second pinion gear coaxial with axis A of the head, rigidly coupled to the said second eccentric 10 and rotating with it; 13, the first crown gear meshing with the said second pinion, but with eccentric rotational motion on axis P, parallel to the previous axes, but with eccentricity C; 14, a first eccentric pinion rigidly connected to the said first crown gear and rotating with it, meshing with a first crown gear 15 rigidly fixed to the housing 6 and rotating with it on axis A of the head; 16, lubricating oil passages; 17, the rolling bearing coupling with rotational motion the said second crown gear 13 and the first pinion 14 to a second eccentric 18, with said eccentricity C with respect to axis A of the head, and rigidly fixed to the prismatic reaction arms 19, by means of flange 20: the said arms being connected to the structure of the machine.

The figure also shows: 21, the connecting flange for the hollow shaft 22 of the head, inside which the cooling fluid for the grinding segments and the material being machined is made to flow; 23, elastic abutments for connecting the said hollow shaft, by means of joint 24, to the said body 5 of the polishing head; 25, the vertical pin of the eccentric planetary gear 26, coupled with rotational motion to the said ring 7, whereas the eccentric planetary gear is coupled with rotational motion to the body 5 of the head; 27, a chamber below the eccentric planetary gear and 28, a hole in the said planetary gear for lubricating oil connecting the chamber; 29, a sleeve, coaxial with hollow shaft 22, for guiding the rotation of the body 5 of the head, coupled with rotational motion by means of rolling bearings 30 to the inner diameter of the said second eccentric, coaxial with axis A of the said second eccentric 18; 31, the lip seal between the said sleeve 29 and the flange 20; 32, a cover with protective labyrinth for the seal 31; 33, the lip seal between the body of the said second eccentric 18 and the housing 6, with a protective labyrinth 34 for the said seal.

Operation of the polishing head is as follows: the rotation imparted by the drive shaft of the machine, by means of the flange 21, the hollow shaft 22, the joint 24 and abutments 23, is transmitted to the body 5 and housing 6, to which the said second crown gear is attached; the meshing of the said crown gear causes the rotation of the said first pinion 14 and the second crown gear 13, engaged with each other but free to rotate on the rolling bearing 17; the said second eccentric 18, to which the bearing 17 is splined, is kept fixed to the structure of the machine by means of the flange 20 and the prismatic arms 19, constituting reaction to the rotational motion imparted by the first crown gear; the resulting relative rotation between the first crown gear and the first pinion is at low speed on axis P; the rotation of the second pinion 12, meshing with the second crown gear 13, is at an even lower speed than that of the first pinion, but on axis A of the head. The speed of rotation depends therefore on the combined effect of the transmission ratios of the two in-line crown and pinion gear pairs; these have a value which makes the first crown gear 15 coaxial with the said second pinion 12, as in reducers with two pairs of gears with coaxial input and output shafts, thereby providing a linear transmission of the rotational motion to the said first eccentric 10. The oscillating motion is thereby imparted to the abrasive segments 1 by the eccentric rotational motion of the said ring 7 imparted by the relative rotation between the first eccentric and the body 5; the eccentricity B of the first eccentric 10 is determined in finction of the dressing requirements of the abrasive material employed and of the sizing and positioning of the of the arms 2 and pins 4, in a manner not dependant on the eccentricity adopted for the two pairs of crown and pinion gears.

In practice the materials, dimensions and details of execution may be differ from, but technically equivalent to, those indicated without departing from the juridical domain of the present invention.

What is claimed is:

1. A polishing head disposed about an axis (A) and mounted on a machine for polishing plate materials of granite, hard stone or ceramic with grinding segments having continuous tangential oscillating motion, the polishing head comprising: abrasive segments (1) mounted for oscillation on radial shafts (3) each driven by a pin (4) coupled by a cylinder (9) which is mounted to slide in a radial direction to a ring (7), the ring (7) being rotationally coupled to a first eccentric (10) which is driven by gears with internal teeth to import a vertical eccentric motion to the ring (7), the gears including a first crown gear (15) fixed to a housing (6) of the polishing head and a first pinion (14) coupled with rotatory motion to a second eccentric (18), which second eccentric (18) is in turn coupled with an anti-rotational joint (19, 20) to the structure of the machine onto which the head is mounted; a plurality of pins (25) mounted on eccentric planetary gears (26) having an eccentricity equal to that of said first eccentric 10 and coupled with rotational motion to said ring (7)and to a body portion (5) of the polishing head; the polishing head further including another pair of crown and pinion gears, in which a second crown gear (13) is rigidly connected to the first pinion (14) that is rotationally coupled to said eccentric (18); the second pinion (12) being connected rigidly to the said first eccentric (10) concentrically with respect to the axis (A) of the head and the first crown gear (15) being rigidly connected to the housing (6) concentrically with the axis of the head.

* * * * *